US006334281B1

(12) United States Patent
Oliver et al.

(10) Patent No.: US 6,334,281 B1
(45) Date of Patent: Jan. 1, 2002

(54) GROUND ANCHOR WITH DOWNWARD BIASED COMPRESSION CAP

(76) Inventors: James Oliver; Evon L. Oliver, both of P.O. Box 9, Hohenwald, TN (US) 38462

( * ) Notice: Subject to any disclaimer, the term of this patent is extended or adjusted under 35 U.S.C. 154(b) by 0 days.

(21) Appl. No.: 09/659,007

(22) Filed: Sep. 11, 2000

Related U.S. Application Data

(63) Continuation-in-part of application No. 09/573,355, filed on May 17, 2000.

(51) Int. Cl.[7] ..... E02D 5/74
(52) U.S. Cl. ..... 52/157; 248/156; 248/545
(58) Field of Search ..... 52/157, 155; 248/156, 248/530, 545; 256/DIG. 5

(56) References Cited

U.S. PATENT DOCUMENTS

| | | | | | |
|---|---|---|---|---|---|
| 204,246 | A | | 5/1878 | Pierce | |
| 284,219 | A | | 9/1883 | Mehew | |
| 571,624 | A | * | 11/1896 | Ryan | 52/157 |
| 2,414,358 | A | * | 1/1947 | Calway | 248/532 |
| 4,863,137 | A | | 9/1989 | Cockman et al. | 248/545 |
| 4,923,165 | A | * | 5/1990 | Cockman | 248/545 |
| 5,011,107 | A | | 4/1991 | Reece | 248/545 |
| 5,123,623 | A | | 6/1992 | McNamara | 248/545 |
| 5,135,192 | A | | 8/1992 | Winkler | 248/156 |
| D336,125 | S | | 6/1993 | Sadler | D21/246 |
| 5,884,874 | A | | 3/1999 | Speece et al. | 248/516 |
| 5,927,677 | A | | 7/1999 | Speece et al. | 248/516 |
| 6,128,867 | A | * | 10/2000 | MacKarvich | 52/157 |

* cited by examiner

*Primary Examiner*—Carl D. Friedman
*Assistant Examiner*—Naoko Slack
(74) *Attorney, Agent, or Firm*—Calif Tervo

(57) ABSTRACT

A ground anchor (10) for boring in soil (90) generally includes an elongate shank (20) having auger blades (34) on its lower end (30) and a attachment mechanism (41) on its upper end (40) for attachment of anchor lines (48), a compression cap (60), and one or more biasing springs (50). Biasing springs (50) operate between upper end (40) of shank (20) and compression cap (60) for maintaining cap (60) biased in a downward direction so that soil between cap (60) and auger (34) remains compressed at all times. Compression cap (60) includes a plate (62) that is freely journaled on shank 20 above blades (34) such that plate (62) can freely tilt through a tilt angle to align with surface (91) of soil (90).

20 Claims, 1 Drawing Sheet

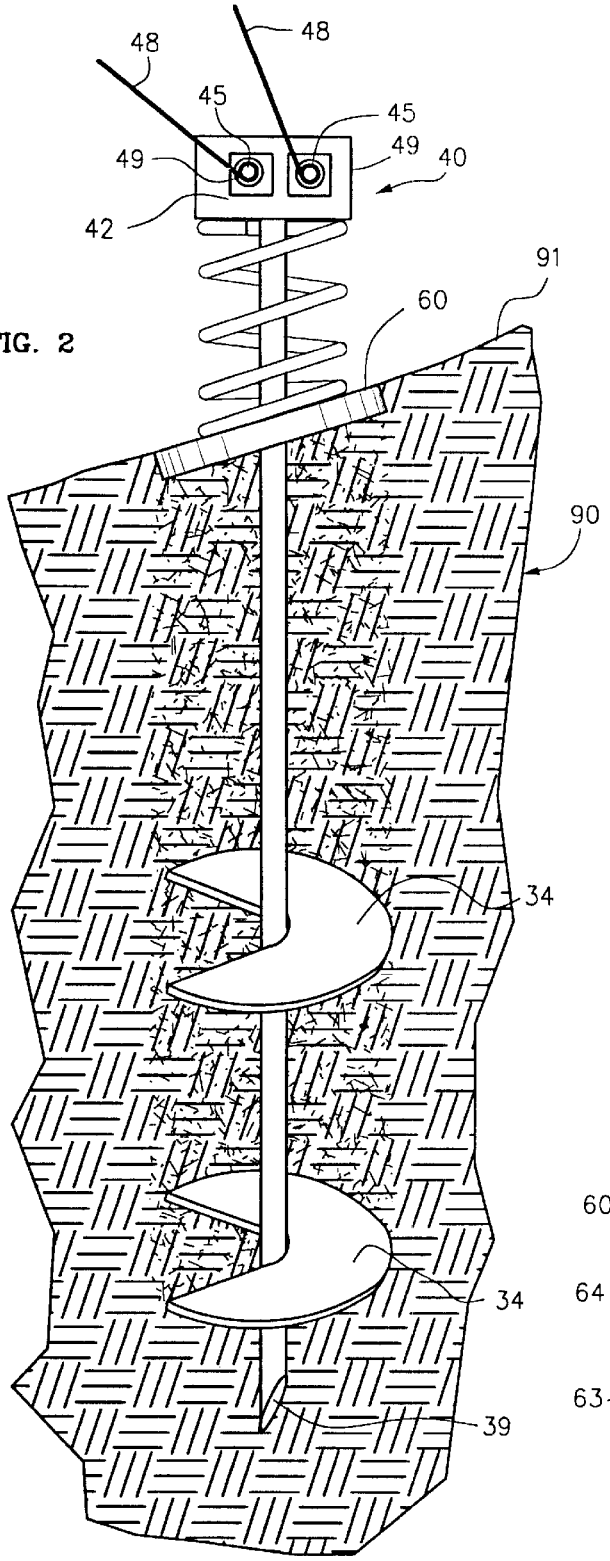
FIG. 2
FIG. 1
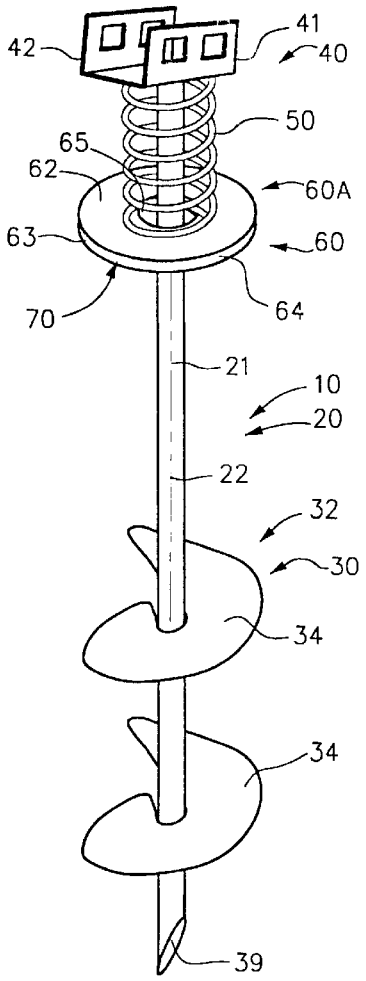
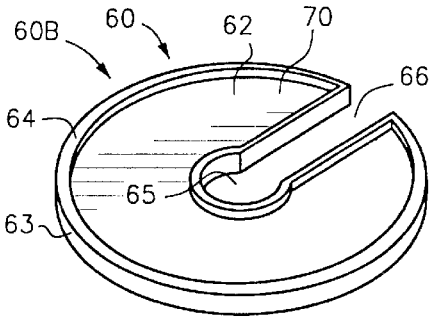
FIG. 3

GROUND ANCHOR WITH DOWNWARD BIASED COMPRESSION CAP

CROSS-REFERENCE TO RELATED APPLICATIONS

This application is a continuation-in-part of co-pending application Ser. No. 09/573,355, filed May 17, 2000, titled Ground Anchor with Self-aligning Compression Cap.

FIELD OF THE INVENTION

This invention relates in general to anchors that are bored into the ground and more specifically to a ground anchor having a cap for compressing soil above an auger wherein the cap is downward biased so as to still provide compression during strain on the anchor and, preferably also, wherein the cap can tilt so as to align with the contour of the grade.

BACKGROUND OF THE INVENTION

Ground anchors of the auger type tend to loosen the soil as the auger is screwed into the earth. This tends to make the anchor shaft less stable. Particularly, the upper end of the anchor shaft may be able to move back and forth laterally in the loosened soil and thereby loosen the anchor such that the anchor becomes ineffective. Our above-identified co-pending application, teaches the use of a compression cap on the upper end of the shaft. The compression cap is pulled against the top of the disturbed soil by the auger action and bears against and compresses the soil that has been disturbed by the auger. This soil compaction greatly increases the stability of the upper end of the anchor shaft. However, in conditions of large fluctuating forces on anchor lines, such as encountered during a hurricane or tornado, anchors pull out at a undesirable rate.

Accordingly, there has been a need for an improved ground anchor.

SUMMARY OF THE INVENTION

The invention is a ground anchor for boring in the soil, and it generally includes an elongate shank having an auger on its lower end and a attachment mechanism on its upper end for attachment of anchor lines, a compression cap, and biasing means, such as a spring, operating between the upper end of the shank and the compression cap for biasing the cap in a downward direction so as to compress soil between the cap and the auger.

The compression cap is a generally disk-shaped plate of uniform thickness having an aperture freely journaling it on the shank above the soil such that said plate can freely tilt through a tilt angle to align with the surface of the soil. Preferably, a side slot provides entry of the shaft to the central aperture.

The cap has a generally planar downward facing surface for compressing soil between the cap and the auger blades. Preferably, the cap has peripheral side walls extending upwards or downwards from the perimeter of the plate for bearing against the soil for presenting a larger side surface area than the plate for preventing lateral movement.

The biasing means may be one or more springs. Coil, leaf or torsion springs may be used. The spring biases the cap in a downward direction so that soil between the cap and the auger remains compacted at all times. This compacted soil helps prevent lateral movement of shaft 21 and bears laterally outward to prevent upward movement of the auger.

Other features and many attendant advantages of the invention will become more apparent upon a reading of the following detailed description together with the drawings wherein like reference numerals refer to like parts throughout.

BRIEF DESCRIPTION OF THE DRAWING

FIG. 1 is a perspective view of a first embodiment of the ground anchor of the invention.

FIG. 2 is an enlarged side elevation view of the anchor of FIG. 1 in the ground further including anchor bolts and straps.

FIG. 3 is an enlarged bottom perspective view of an alternate compression cap.

DETAILED DESCRIPTION OF THE INVENTION

With reference now to the drawings, and first particularly to FIGS. 1 and 2 thereof, FIG. 1 is a perspective view of a first embodiment of the ground anchor 10 of the invention; FIG. 2 is an enlarged side elevation view of the anchor of FIG. 1 in the ground, such as soil 90, further including anchor lines 48 and tensioning bolts 45.

Ground anchor 10 generally includes a shank 20, a compression cap 60, such as disk cap 60A, and biasing means, such as a spring, such as coil spring 50, operating between the upper end 40 of shank 20 and cap 60 for biasing cap 60 in a downward direction. Shank 20 is an elongate shaft 21, such as a rod or pipe of metal, such as steel, having a longitudinal axis 22. Shank 20 includes a lower end, such as boring end 30, and an upper end 40 including attachment means 41. Boring end 30 includes a tip 39 and auger means, 32, such as a helical blade 34, for boring in soil 90. Auger means 32 shown is a pair of helical blades 34 attached, such as by any suitable means, such as welding, to shaft 21. Alternately, auger 32 may be any means capable of boring shank into soil 90. Blades 34 have a maximum radius. Thus, as blades 34 bore in soil 90, soil 90 is loosened over a circle of known maximum diameter, that is, a diameter of twice the maximum radius.

Attachment means 41 on upper end 40 of shank 20 includes attachment bracket 42 for attachment of one or more anchor lines 48. Anchor lines 48 have a lower end 49 wrapped on a tensioning bolt 45 as is well-known in the art. Shank 20 is shown bored into soil 90 such that the tension forces in anchor lines 48 tend to pull upper end 40 upwards and sideways toward the object anchored.

Compression cap 60 includes a generally disk-shaped plate 62 of generally uniform thickness and having a perimeter 63. Cap 60 includes an aperture, such as central aperture 65 freely journaling plate 62 on shank 20 above soil 90 such that plate 62 can move longitudinally along shaft 21, and preferably, also such that cap 60 can tilt through a tilt angle, such as of at least seven degrees and preferably of about ten to fifteen degrees. Thus, preferably, aperture 65 is larger than the cross-sectional area of shaft 21. Cap 60 includes a generally planar downward facing surface 70 for compressing soil 90 between cap 60 and auger means 32. Preferably, compression cap 60 has a radius approximating that of the maximum radius of the blades 34.

FIG. 3 is an enlarged bottom perspective view of an alternate compression cap 60, slotted cap 60B. Slotted cap 60B is similar to disk cap 60A, as described above, but includes a radial slot 66 for providing side entry of shaft 21 to an aperture, such as central aperture 65 such that cap 60B can easily be attached to shaft 21 after shaft 21 has been bored most of the way into soil 90. In this manner, cap 60B is not in the way during boring.

Cap 60 may includes side wall means, such as side wall 64, extending upwards or downwards (as shown) from perimeter 63 of plate 62 for presenting a larger side surface area than plate 62 to aid in preventing lateral movement of cap 60 and shaft through soil 90.

Spring 50 operating between upper end 40 of shank 20, such as between attachment bracket 42, and cap 60 for biasing cap 60 in a downward direction so as to compress soil 90 between cap 60 and auger blades 34. Spring 50 is a single coil having a central aperture receiving shaft 21. Shaft 21 stabilizes the single spring 50 and spring 50 does not require other attaching means. Although a single coil spring 50 is shown and described, other biasing means are contemplated. For example, a plurality of coil springs may be used. The springs may have a common central aperture or may be spaced from shaft 21. Other types of springs, such as torsion or leaf springs may be used. Preferably, the biasing means can be applied after anchor 10 is bored into soil 90. For example, the coils of spring 50 may be spaced so that spring 50 may be threaded over shaft 21. A plurality of springs may be placed between attachment bracket 42 and cap 60 after boring. The single spring or multiple springs allow cap 60 to tilt so as to align with surface 91 of soil 90.

As an example of a preferred use, a shank 20 with no spring 50 and no cap 60 bored in soil 90 until the auger blades 34 are under soil 90 or until upper end 40 nears soil surface 91. Then, cap 60, such as cap 60B, is slid onto shaft 21 just above soil surface 91 and rested on soil surface 91 so as to align with the contour of the grade. Then, spring 50 is threaded on shaft 51 and rested on cap 60B. Shank 20 is then bored into soil 90 until spring 50 is compressed sufficiently so as to remain compressed as soil 90 further compresses over time. The constant downward biasing of compression cap 60 keeps the soil compressed so as to prevent lateral movement of shaft 21 and also causes the compressed soil 90 under cap 60 to bear against the side wall of the augered hole and thereby act as a plug preventing upward movement of augers 34.

Having described the invention, it can be seen that it provides a very convenient apparatus for efficient and reliable ground anchoring.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A ground anchor including:

an elongate shank having a longitudinal axis; said shank including:

a boring end including:

auger means for boring in the soil; and an upper end including:

attachment means for attachment of an anchor line;

a compression cap including:

an aperture freely journaling said cap on said shank below said attachment means; said cap for positioning on top of soil disturbed by said auger means; and biasing means located between said upper end of said shank and said compression cap for biasing said cap in a downward direction so as to compress soil between said cap and said auger means.

2. The ground anchor of claim 1 wherein:

said biasing means includes a spring.

3. The ground anchor of claim 1 wherein:

said biasing means includes a coil spring.

4. The ground anchor of claim 1 wherein:

said compression cap has a radius approximating that of the maximum radius of said auger means.

5. The ground anchor of claim 4 wherein:

said biasing means includes a spring.

6. The ground anchor of claim 4 wherein:

said biasing means includes a coil spring.

7. The ground anchor of claim 1 wherein:

said compression cap includes a slot providing entry of said shaft to said aperture.

8. The ground anchor of claim 7 wherein:

said biasing means includes a spring.

9. The ground anchor of claim 8 wherein:

said auger means includes:

a helical blade having a maximum radius; and wherein said compression cap has a radius approximating that of the maximum radius of said blade.

10. The ground anchor of claim 7 wherein:

said biasing means includes a coil spring.

11. A ground anchor including:

an elongate shank having a longitudinal axis; said shank including:

a boring end including:

auger means for boring in the soil; and an upper end including:

attachment means for attachment of an anchor line;

a compression cap including:

an aperture freely journaling said cap on said shank below said attachment means such that said cap can freely tilt through a tilt angle of at least seven degrees; said cap for positioning on top of soil disturbed by said auger means; and biasing means located between said upper end of said shank and said compression cap for biasing said cap in a downward direction so as to compress soil between said cap and said auger means.

12. The ground anchor of claim 11 wherein:

said auger means includes:

a helical blade having a maximum radius; and wherein said compression cap has a radius approximating that of the maximum radius of said blade.

13. The ground anchor of claim 12 wherein:

said biasing means includes a spring.

14. The ground anchor of claim 13 wherein:

said biasing means includes a coil spring.

15. The ground anchor of claim 11 wherein:

said compression cap includes a slot providing entry of said shaft to said aperture.

16. The ground anchor of claim 15 wherein:

said biasing means includes a spring.

17. The ground anchor of claim 15 wherein:

said biasing means includes a coil spring.

18. A ground anchor including:

an elongate shank having a longitudinal axis; said shank including:

a boring end including:

auger means for boring in the soil; and an upper end including:

attachment means for attachment of an anchor line;

a compression cap including:

a generally disk-shaped plate of generally uniform thickness and having a perimeter; said plate including:

an aperture freely journaling said plate on said shank above soil disturbed by said auger means and such that said plate can freely tilt through a tilt angle of at least ten degrees;

a generally planar downward facing surface for compressing soil between said cap and said auger means; and side wall means extending upwards or downwards from said plate; said side wall means for bearing against the soil for presenting a larger side surface area than said plate for preventing lateral movement; and biasing means located between said upper end of said shank and said compression cap for biasing said cap in a downward direction so as to compress soil between said cap and said auger means.

19. The ground anchor of claim 18 wherein:

said biasing means includes a spring.

20. The ground anchor of claim 18 wherein:

said biasing means includes a coil spring.

* * * * *